US005144201A

United States Patent [19]

Graham et al.

[11] Patent Number: 5,144,201

[45] Date of Patent: Sep. 1, 1992

[54] LOW WATT METAL HALIDE LAMP

[75] Inventors: Timothy W. Graham, Union Springs; Daniel C. Briggs, Camillus, both of N.Y.

[73] Assignee: Welch Allyn, Inc., Skaneateles Falls, N.Y.

[21] Appl. No.: 484,166

[22] Filed: Feb. 23, 1990

[51] Int. Cl.[5] ..... H01J 17/16

[52] U.S. Cl. ..... 313/634; 313/620; 313/623

[58] Field of Search ..... 313/620, 634, 573, 623, 313/621

[56] References Cited

U.S. PATENT DOCUMENTS

| | | | |
|---|---|---|---|
| 3,234,421 | 2/1966 | Reiling | 313/25 |
| 3,259,777 | 7/1966 | Fridrich | 313/570 |
| 3,263,852 | 8/1966 | Fridrich | 313/110 X |
| 3,305,289 | 2/1967 | Fridrich | 445/14 |
| 3,324,332 | 6/1967 | Waymouth et al. | 313/623 |
| 3,577,029 | 5/1971 | Koury et al. | 313/641 |
| 3,654,506 | 4/1972 | Kuhl et al. | 313/641 |
| 3,714,493 | 1/1973 | Fridrich | 313/571 |
| 3,879,233 | 7/1975 | Szilagyi | 148/26 |
| 4,053,809 | 10/1977 | Fridrich et al. | 313/594 |
| 4,136,298 | 1/1979 | Hansler | 313/623 |
| 4,161,672 | 7/1979 | Cap et al. | 313/620 |
| 4,202,999 | 5/1980 | Holle et al. | 313/317 |
| 4,396,857 | 8/1983 | Danko | 313/634 |
| 4,468,590 | 8/1984 | Akutsu et al. | 313/573 |
| 4,528,478 | 7/1985 | Rothwell, Jr. et al. | 313/631 |
| 4,594,529 | 6/1986 | de Vrijer | 313/571 |
| 4,612,000 | 9/1986 | English et al. | 313/634 |
| 4,633,136 | 12/1986 | Fromm et al. | 313/623 |
| 4,709,184 | 11/1987 | Keeffe et al. | 313/638 |
| 4,717,852 | 1/1988 | Dobrusskin et al. | 313/25 |
| 4,756,701 | 7/1988 | Danko et al. | 313/569 |
| 4,782,266 | 11/1988 | Heider et al. | 313/631 |
| 4,795,943 | 1/1989 | Antonis et al. | 313/620 |
| 4,808,876 | 2/1989 | French et al. | 313/25 |

*Primary Examiner*—Donald J. Yusko
*Assistant Examiner*—Michael Horabik
*Attorney, Agent, or Firm*—Wall and Roehrig

[57] ABSTRACT

A metal halide arc discharge lamp is disclosed having a power input rating of not more than 35 watts. The lamp includes an envelope of light transmissive material, such as fused quartz, including a bulb portion, a pair of transitional neck portions extending from the bulb portion, and a pair of stem portions extending from the transitional neck portions respectively. The bulb portion of the envelope defines an arc chamber therein and has an external surface area of such value as to produce a wall loading not exceeding 35 watts/cm$^2$. The arc chamber contains a fill of mercury, inert gas and metal halide. The mercury and the metal halide are adapted to substantially vaporize during operation of the lamp. A pair of electrodes extend into the arc chamber from the pair of neck portions respectively. Each electrode has an electrode tip spaced apart from one another by a distance A within the arc chamber. The neck portions of the envelope each have a wall surrounding a segment of one of the electrodes. The walls of the neck portions each have a stretched section with a minimum wall thickness not exceeding about 1.5 mm. A pair of inlead assemblies are electrically coupled to the pair of electrodes respectively. The inlead assemblies pass from the electrodes through a hermetically sealed section in the stem portions of the envelope to the exterior of the lamp.

37 Claims, 3 Drawing Sheets

LOW WATT METAL HALIDE LAMP

BACKGROUND OF THE INVENTION

This invention relates in general to the field of metal halide arc discharge lamps and, in particular, to miniature low watt metal halide lamps of 35 watts or less achieving high efficacy and controlled color temperature performance.

In a typical prior art metal halide lamp, an envelope of vitreous silica material defines an arc chamber which contains a fill of mercury, inert gas, and metal halide. Sealed in the arc chamber is a pair of refractory tungsten electrodes having tips spaced apart from one another. After an arc discharge is established between the electrode tips, the temperature of the arc chamber rapidly increases, causing the mercury and metal halide to vaporize. The mercury atoms and metal atoms of the metal halide are ionized and excited, causing emissions of radiation at spectrums characteristic of the respective metals. This radiation is substantially combined within the arc chamber to produce a resultant light output having an established intensity and color temperature.

The color temperature and efficacy (usually expressed in terms of lumens per watt) are primarily dependent upon the vapor pressure of the halides in the arc chamber during lamp operation. Halide vapor pressure is strongly affected by the temperature of the wall of the envelope defining the arc chamber.

As is typical in prior art lamps, the metal halide does not entirely vaporize during operation. In fact, a noticeable condensate exists in the cooler regions of the arc chamber. It has been long understood that this halide condensation, particularly in lower wattage lamps, can significantly reduce efficacy and increase color temperature to unacceptable levels. Moreover, for double-ended lamps, halide condensation generally occurs at the opposing ends where the electrodes emerge from the vitreous silica material. These end regions are normally the coolest in the arc chamber. For double-ended lamps, this result is especially disadvantageous in that the temperature of these end regions are sensitive to manufacturing variations and variations occurring over time. Hence, the efficacy and color temperature performance of these lamps can vary significantly over their lifetime and from one lamp to another. Such variations are unacceptable in many applications.

Various attempts have been made to reduce the halide condensation in the end regions of the arc chamber. For example, Cap et al. U.S. Pat. No. 4,161,672 discloses that by reducing the cross-sectional area of the end shanks of the lamp envelope, the thermal loss through these shanks can be reduced. Cap et al. also discloses the use of opaque coatings of zirconiumoxide at the end regions to retain heat within the chamber. French et al. U.S. Pat. No. 4, 808,876 and Waymouth et al. U.S. Pat. No. 3,324,332 also disclose the use of end coatings and reduced dimensions in the envelope end seals or shanks. In addition, French et al. and Waymouth et al. disclose the use of end chambers or wells at the ends of the arc chamber. The wells have a reduced cross-section from the main body of the arc chamber to increase the temperature at the end regions.

In another example, Holle et al. U.S. Pat. No. 4,202,999 discloses that by reducing the physical size of the electrodes of miniature metal halide lamps, the heat loss through them is reduced, resulting in higher operational temperatures and higher efficacy.

In all of the above examples, the various techniques described have not been sufficient to adequately reduce halide condensation in the end regions of the arc chamber. In each example, the disclosed lamp design requires that the tips of the electrodes be relatively close to the end regions in order to maintain an adequate vaporizing temperature in these regions. Therefore, the distance over which the electrodes can be inserted into the arc chamber (i.e. insertion depth) is restricted in these prior art metal halide lamps. Such a restriction on insertion depth necessarily imposes a limit on the spacing between the electrode tips (assuming acceptable wall loading requirements must be maintained). As will be described below, this limitation can result in low efficacy levels for miniature metal halide lamps having input power ratings of 35 watts and below.

OBJECTS AND SUMMARY OF THE INVENTION

It is accordingly an object of the present invention to provide apparatus that overcome the problems associated with the prior art.

Another object of the present invention is to provide new miniature metal halide arc discharge lamps having power input ratings of 35 watts or less and achieving efficacy and color temperature performance that has not been possible with prior art lamps.

A further object of the present invention is to provide new miniature metal halide arc discharge lamps having power input ratings of 35 watts or less and achieving acceptable levels of efficacy and color temperature performance over the entire life of the lamps.

Still another object of the present invention is to provide new miniature metal halide arc discharge lamps having power input ratings of 35 watts or less that are relatively insensitive to manufacturing variations.

Yet another object of the present invention is provide new miniature metal halide arc discharge lamps having power input ratings of 35 watts or less and relatively short warm-up times.

These and other objects are attained in accordance with the present invention wherein there is provided a metal halide arc discharge lamp having a power input rating of not more than 35 watts. The lamp, according to the present invention, comprises an envelope of light transmissive material including a bulb portion, a pair of transitional neck portions extending from the bulb portion, and a pair of stem portions extending from the transitional neck portions respectively. The bulb portion of the envelope defines an arc chamber therein and has an external surface area of such value as to produce a wall loading not exceeding about 35 watts /cm$^2$. Contained within the arc chamber is a fill of mercury, inert gas and metal halide. The mercury and metal halide are adapted to substantially vaporize during operation of the lamp. Extending into the arc chamber from the neck portions is a pair of electrodes having electrode tips spaced apart from one another by a distance A within the arc chamber. The neck portions of the envelope each have a wall surrounding a segment of the electrodes respectively. The walls of the neck portions each have a stretched section with a minimum wall thickness not exceeding 1.5 mm. The lamp also includes a pair of inlead assemblies electrically coupled to the pair of electrodes respectively. The inlead assemblies pass from the electrodes through a sealed section in the stem portions of the envelope to the exterior of the lamp.

BRIEF DESCRIPTION OF THE DRAWING

One way of carrying out the invention is described in detail below with reference to drawings which illustrate three specific embodiments, in which.

DETAILED DESCRIPTION OF THE PREFERRED EMBODIMENT

Figure 1:
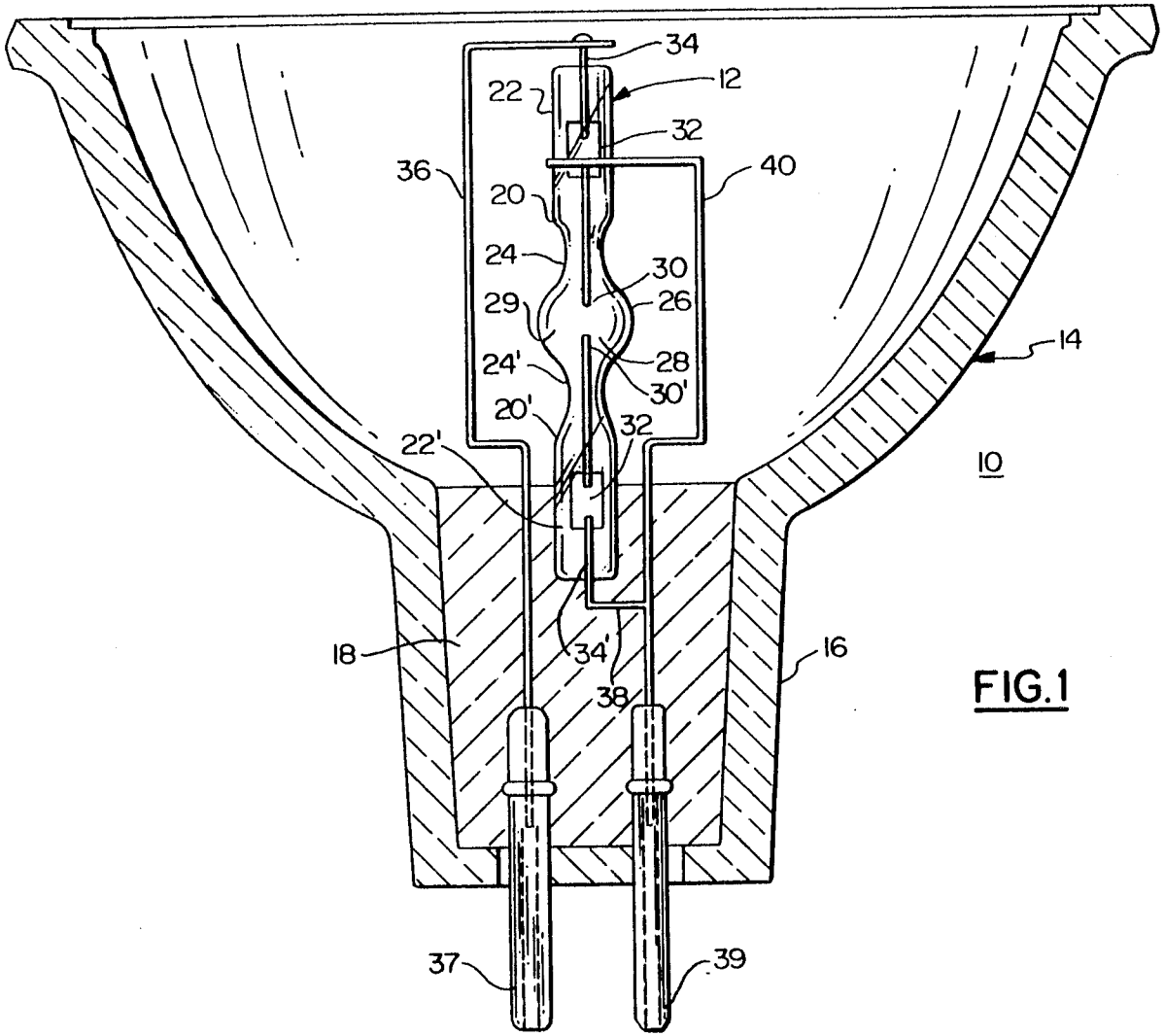
FIG. 1 is an elevation view illustrating a 20 watt reflector based metal halide lamp according to the present invention.

With reference to the Drawing, and initially to FIG. 1 thereof, a lamp and reflector assembly 10 is shown in a partial cross-sectional and elevational view. A miniature metal halide low watt arc discharge lamp 12, constructed according to the present invention, is shown based in an ellipsoid reflector 14. Lamp 12 is fixed into a collar 16 of reflector 14 with a ceramic or glassy cement compound 18. Cement compound 18 can be a zirconiumoxide product manufactured by Cotronics. Lamp 12 comprises an envelope of light transmissive material, such as vitreous silica. In the preferred embodiment, a fused quartz material is used, such as Type 214 manufactured by General Electric Company. The lamp envelope includes a pair of envelope shanks 20, 20' which comprise stem portions 22, 22' and transitional neck portions 24, 24'. Situated between envelope shanks 20 and 20' is a bulb portion 26 of the lamp envelope.

Defined within the wall of bulb portion 26 is an arc chamber 28. Contained within arc chamber 28 is a chemical fill 29 of mercury and metal halide. As shown in FIG. 1, the mercury and metal halide are condensed on the interior surface of the wall of arc chamber 28 at room temperature. In addition to the metal halide and mercury, an inert gas, such as argon, occupies arc chamber 28 under a pressure of several hundred Torr.

Lamp 12 is designed to operate on a direct current (D.C.) input. However, the aspects of the present invention are equally applicable to A.C. operated metal halide lamps. As shown in FIG. 1, a pair of tungsten wire electrodes 30, 30' project into arc chamber 28 from neck portions 24, 24'. Electrode 30 is the cathode and electrode 30' is the anode. Each electrode terminates at an electrode tip, within arc chamber 28, as is more clearly shown in FIGS. 2–5. Electrodes 30, 30' are connected to respective molybdenum ribbon foils 32, 32' by lap welds. The envelope of lamp 12 is hermetically sealed at ribbon foils 32, 32'. As will be described below, stem portions 22, 22' are heated until wetting of the quartz occurs around ribbon foils 32, 32'. Upon cooling, a hermetic seal is established about the foils.

Also connected to ribbon foils 32, 32' are respective molybdenum wire inleads 34, 34'. The connections are effected by lap welds to ribbon foils 32, 32'. An assembly, including a ribbon foil and a wire inlead is referred to herein as an inlead assembly. An assembly, including a wire inlead, a ribbon foil and an electrode is referred to herein as an electrode assembly.

Wire inlead 34 is electrically connected to a long contact rod 36 which is, in turn, connected to a pin conductor 37. Wire inlead 34' is electrically connected to a short contact rod 38 which is, in turn, connected to a pin conductor 39. Also connected to short contact rod 38 is an external starting aid 40. Starting aid 40 will cause lamp 12 to start more reliably and at a lower value of starting voltage. Starting aid 40 is made of nickel and is positioned outside the quartz envelope of lamp 12.

From its connection at short contact rod 38, starting aid 40 extends to stem portion 22. Starting aid 40 is wrapped around stem portion 22 at ribbon foil 32, as shown in FIG. 1. The basic theory of operation and construction of starting aid 40 is well known in the lamp-making art. For example, U.S. Pat. No. 4,053,809 to Fridrich et al. discloses the basic teachings and construction of external starting devices.

Several lamp design concepts are now introduced for a better understanding of the aspects of the present invention. One concept, important to considerations of adequate lamp life and lumen maintenance, is wall loading. Wall loading is defined as the input watts into the lamp divided by the external radiating surface area of the arc chamber. As an approximation, the radiating surface is taken as the external surface of the envelope, excluding the end shanks. Excessive wall loading can cause envelope devitrification at an accelerated rate, resulting in poor lumen maintenance and shortened lamp life. For quartz envelopes having wall thicknesses of less than 1.5 mm, the wall loading should be less than 35 watts /cm$^2$ to ensure adequate lumen maintenance and lamp life.

Another concept, which relates directly to lamp efficacy, is arc loading. Arc loading is defined as the input watts into the lamp divided by the arc distance A. The arc distance is equivalent to the distance between the tips of the electrodes within the arc chamber. For a given power input, a short arc distance results in a high arc loading. High arc loadings result in higher efficacies for the low watt metal halide lamps of the present invention.

Metal halide lamps of the prior art are hampered by a limitation on arc loading. This limitation stems from the requirement that the tips of the electrode are to remain relatively close to the end regions of the arc chamber. Under such a requirement, the only plausible way to decrease the arc distance is to reduce the arc chamber length. However, a reduction in the arc chamber length will usually result in a smaller radiating surface area of the arc chamber. A smaller surface area will, in turn, result in a higher wall loading. Therefore, if the chamber length is reduced beyond a certain point, the wall loading may exceed acceptable values. The lamps disclosed in Cap et al. U.S. Pat. No. 4,161,672, are designed not to exceed an arc loading of 150 watts /cm to avoid wall loadings above 35 watts /cm$^2$.

The metal halide lamps of the present invention are not so constrained. In accordance with the invention, the electrodes may be inserted a greater distance into the arc chamber than the prior art lamps, without experiencing unacceptable levels of halide condensation in the end regions. Hence, the insertion depth 1 of the electrodes can be much greater, for a given arc chamber length, than the prior art lamps. Greater insertion depths lead to shorter arc distances, which, in turn, result in higher lamp efficacy; and higher efficacy is achieved without affecting wall loading.

Another design concept is insertion factor Y. Insertion factor Y corresponds to the formula:

$$Y=(W-A)/W.$$

For most applications contemplated by the inventors at this time, the electrode insertion depth 1 at both ends of the arc chamber will be approximately equal. Therefore, Y follows the relationship:

$$Y=2(1)/W.$$

The insertion factors for the lamps of the present invention are generally much greater than those of prior art lamps due to the employment of greater insertion depths. In the preferred embodiments, the insertion factor is greater than a value of 0.6.

Figure 2:
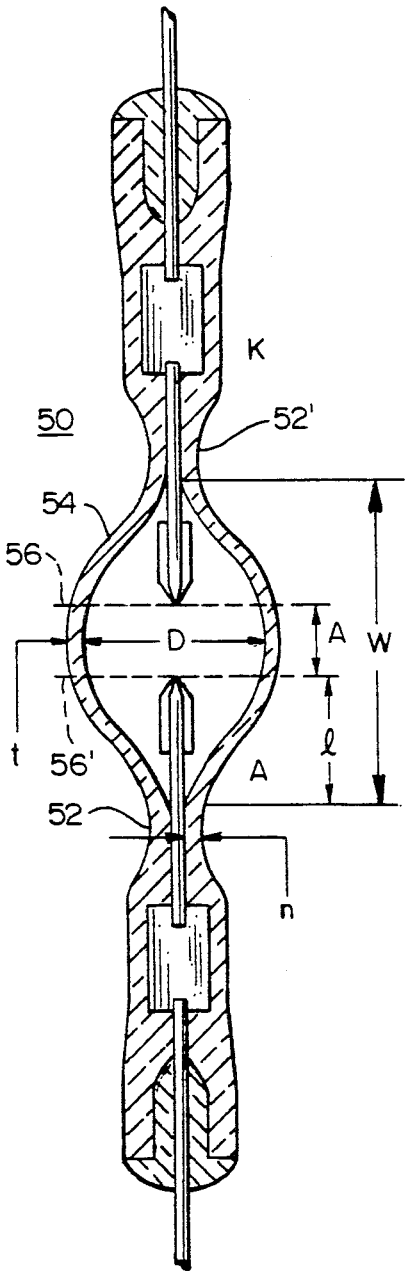
FIG. 2 is a partial cross-sectional view illustrating an unbased metal halide lamp of the present invention and showing critical dimensional points of the lamp.

The metal halide lamps of the present invention attain improvements in efficacy and control over color temperature because halide condensation is minimized in the end regions of the arc chamber during lamp operation. One aspect of the invention contributing to this result is the employment of very thin fused quartz walls in the transitional neck portion of the lamp envelope. Referring to FIG. 2, there is shown a partial cross-sectional view illustrating a metal halide lamp 50, constructed in accordance with the present invention. In addition, FIG. 2 shows critical dimensional points of the lamp. As shown in FIG. 2, transitional neck portions 52, 52' have a minimum wall thickness designated as (n). It has been determined that wall thickness (n) should not exceed about 1.5 mm in order to retain the advantages of the present invention. As will be described herein below, transitional neck portions 52, 52' are produced, in part, by stretching the quartz during manufacture of the lamp envelope. The step of stretching the quartz operates to compensate for the natural gathering or thickening of the quartz while it is being heated. By maintaining the dimension (n) not greater than 1.5 mm, thermal losses through neck portions 52, 52' are minimized, resulting in hotter end regions in the arc chamber of the lamp. Lamps in the 18 to 35 watt power range should have reduced neck sections in a range of between 0.5 to 1.5 mm. Lamps having power ratings below 11 watts should have a minimum reduced neck section of less than 0.5 mm. Lamps in the lower power ranges of between 1.5 to 3.5 watts should have a reduced neck section of about 0.3 mm or less.

Another aspect of the invention is that the arc chamber walls are made very thin, usually not exceeding about 0.5 mm. As shown in FIG. 2, the envelope of lamp 50 has a bulb portion 54 with a wall thickness (t). Wall thickness (t) is defined over a centrally disposed segment of bulb portion 54, bounded by two imaginary parallel planes 56, 56' that are located at the tips of the electrodes of lamp 50. By maintaining the dimension (t) not greater than 0.5 mm, the thermal losses through the wall of bulb portion 54 is minimized, resulting in higher arc chamber temperatures during lamp operation. In addition, by reducing (t), the external surface area of bulb portion 54 is reduced for a given internal arc chamber volume. It is believed that this reduction in external surface area results in lower thermal diffusion from the quartz bulb to the ambient air.

Another aspect of the invention, contributing to the attainment of higher efficacies and controlled color temperature is that the wall of bulb portion 54 has a uniform thickness over the segment defined between imaginary parallel planes 56, 56'. Uniformity in the thickness of the wall results in lower thermal losses through the wall, and a more even thermal distribution within the arc chamber during operation of the lamp.

The preferred geometries for the arc chamber of lamp 50 are ellipsoids and spheroids and approximation thereof. The proportions of the arc chamber can be expressed in terms of its internal length W and internal diameter D. As shown in FIG. 2, the internal arc chamber length W is defined between the points where the electrodes emerge from the fused quartz envelope inside the arc chamber. The internal diameter D of the arc chamber is the diameter at the maximum transverse cross-section of the arc chamber. In most cases, this point is at or near the center of the arc chamber. A useful expression in considering arc chamber geometry is the aspect ratio. The aspect ratio of the arc chamber is defined by the ratio of arc chamber length W divided by internal diameter D (W/D). Metal halide lamps constructed in accordance with the present invention may have aspect ratios in the range of between 1.3 and 2.3.

As shown in FIG. 2, the insertion depth 1, of the electrodes of lamp 50, is defined as the distance over which the electrodes project into the arc chamber from the point where the electrodes emerge from the fused quartz envelope. It has been determined that for lamps designed with power inputs of between 11 and 35 watts, the insertion depth of the electrodes is to exceed 1.5 mm.

With further reference to FIG. 2, there is shown the arc distance dimension A. Arc distance is a measure of the length of the arc produced between the electrodes of the lamp. This parameter is usually taken as the distance between the tips of the electrodes. As will be illustrated herein below with respect to FIGS. 3–5, in many practical embodiments of the present invention, arc distance A can be set to a value that will produce an arc loading greater than 150 w/cm.

In the preferred embodiment, the internal volume of the arc chamber of lamp 50 will not exceed 0.3 $cm^3$ for any size lamp of 35 watts or less. As will be described herein below with respect to FIGS. 3–5, many practical embodiments of the present invention will have arc chamber volumes substantially smaller than 0.3 $cm^3$. For instance, in the case of the 20 watt lamp of FIG. 5, the chamber volume is less than 0.05 $cm^3$.

Another aspect of the present invention concerns the metal halide additives contained within the arc chamber of the lamp. It has been determined that in using the metal halides, sodium iodide and scandium tri-iodide, the percentage by weight of these additives is important in optimizing efficacy and controlling color temperature of the lamp. In most general illumination, optics and signal light applications, the percentages by weight are 87% sodium iodide and 13% scandium tri-iodide. It should be understood, however, that the present invention is not limited to the metal halides of sodium and scandium. Any of the metal halides know in the art can be employed in the lamps of the present invention. In particular, the bromide and iodide compounds from the group of elements consisting of scandium, thallium, lithium, zinc, mercury, dysprosium, indium, cadmium and sodium, are preferred.

Another aspect of the present invention is the attainment of relatively short warm-up times for the lamps. The warm-up time is defined as the time interval between the striking of the lamp with a start pulse and the achievement of steady - state operation. The lamps of the present invention have warm-up times of less than 30 seconds. The factors contributing to short warm-up times in the lamps of the present invention include, small diameter electrodes (less than 0.254 mm), relatively long insertion depths, small arc chamber volumes (less than 0.3 $cm^3$), and low metal halide densities (less than 10 $mg/cm^3$).

Figure 3:
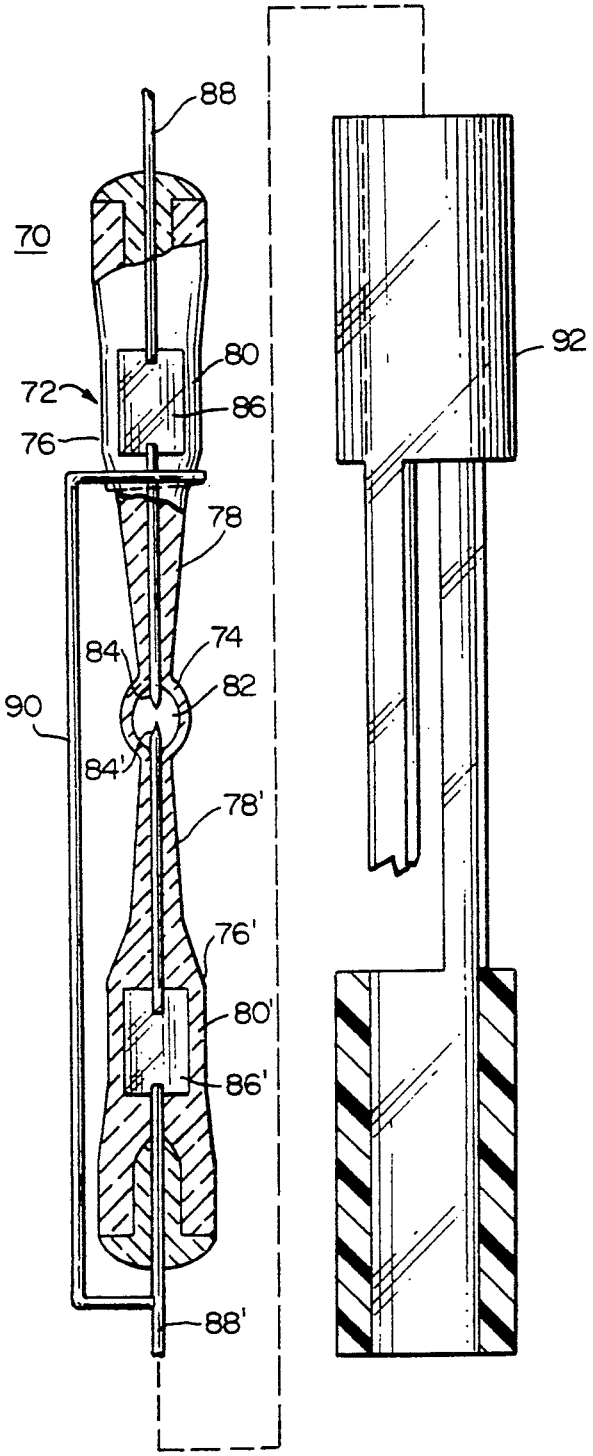
FIG. 3 is an enlarged partial cross-sectional view illustrating a 2.5 watt unbased metal halide lamp according to the present invention.

Referring now to FIG. 3, there is shown a 2.5 watt metal halide arc discharge lamp 70 constructed according to the present invention. Lamp 70 comprises a fused quartz envelope 72 having a bulb portion 74 and a pair of end shanks 76, 76'. End shanks 76, 76' include respective transitional neck portions 78, 78' and respective stem portions 80, 80'. Defined within the wall of bulb portion 74 is an arc chamber 82.

Contained within arc chamber 82 is a fill of mercury, argon gas and the metal halides, sodium iodide and scandium tri-iodide. A pair of tungsten electrodes 84, 84' extend into arc chamber 82 from neck portions 78, 78' respectively. The tips of electrodes 84, 84' are spaced apart from one another by a distance A within arc chamber 82. Electrodes 84, 84' are lap welded to respective molybdenum ribbon foils 86, 86'. Lamp envelope 72 is hermetically sealed at ribbon foils 86, 86'. A pair of molybdenum wire inlead 88, 88' are lap welded respectively to ribbon foils 86, 86'. Electrically connected to wire inlead 88' is a starting aid 90. Starting aid 90 functions as earlier described with respect to starting aid 40, shown in FIG. 1. However, one end of starting aid 90 is wrapped around shank 76 between bulb portion 74 and ribbon foil 86. Lamp 70 is A.C. operated. Electrodes 84, 84' are straight shank tungsten wires of equal length, each having a flared tungsten tip cut at an angle. The shank of each electrode has a diameter of approximately 0.05 mm, and the tip flares out to a diameter of about 0.13 mm.

A quartz tube casing 92 may be used to house lamp 70 for mounting lamp 70 into a fixture, such as the reflector shown in FIG. 1. Typical physical parameters and performance data of lamp 70 are shown in Table 1.

TABLE 1

| 2.5 Watt Metal Halide Lamp | |
|---|---|
| Arc Chamber Diameter (D) | 0.08 cm |
| Arc Chamber Length (W) | 0.14 cm |
| Arc Chamber Volume | $8 \times 10^{-4}$ $cm^3$ |
| Arc Distance (A) | .008 cm |
| Arc Loading | 312.5 w/cm |
| Aspect Ratio (W/D) | 1.75 |
| Chamber Wall Thickness (t) | 0.11 mm |
| Color Temperature | 3,800° K. |
| Efficacy | 38 lpw |
| Electrode Diameter | .05 mm |
| Insertion Depth (1) | .066 cm |
| Insertion Factor (Y) | 0.94 |
| Mercury Loading | .112 mg |
| Metal Halide Loading (87% NaI, 13% $ScI_3$) | .025 mg |
| Neck Wall Thickness (n) | 0.3 mm |
| Wall Loading | 14 $w/cm^2$ |
| Warm-up Time | <5 sec. |

In the preferred embodiment of the 2.5 watt metal halide lamp of the present invention, the internal diameter D of arc chamber 82 may range between 0.08 and 0.11 cm. The length W of arc chamber 82 may range between 0.14 and 0.185 cm. The arc distance A may range between 0.075 and 0.28 mm. The wall thickness (t) of bulb portion 74 is approximately 0.11 mm. The diameter of electrodes 84, 84' may range between 0.04 and 0.076 mm. The insertion depth 1 may range between 0.6 and 0.8 mm. The mercury loading may range between 0.096 and 0.112 mg, and the metal halide loading is approximately 0.025 mg. The metal halide loading comprises 87% sodium iodide and 13% scandium tri-iodide. The pressure of the argon gas, at room temperature, is approximately 540 Torr (10.44 PSI Absolute). The wall thickness (n) of neck portions 78, 78' is less than 0.5 mm. The aspect ratio (W/D) may range between 1.3 and 2.3. The color temperature of lamp 70 is approximately 3,800° K. The warm-up time is less than 5 seconds. It is believed that these parameter ranges are applicable to lamps having power inputs of between 1.5 and 3.5 watts.

Figure 4:
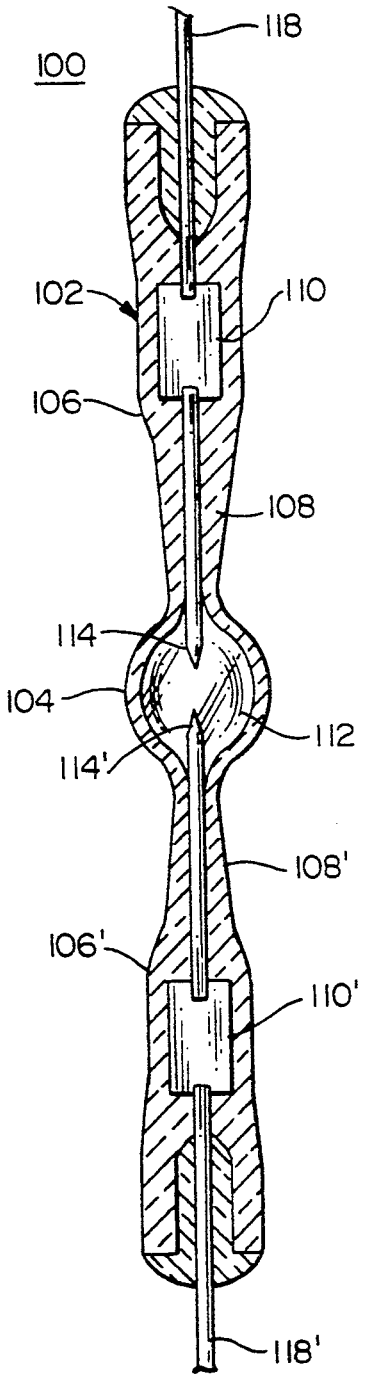
FIG. 4 is an enlarged partial cross-sectional view illustrating a 12 watt unbased metal halide lamp of the present invention.

Referring now to FIG. 4, there is shown a 12 watt metal halide arc discharge lamp 100 constructed according to the present invention. Lamp 100 is made from a fused quartz envelope 102 having a bulb portion 104 and a pair of end shanks 106, 106'. End shanks 106, 106' include transitional neck portions 108, 108' and stem portions 110, 110'. Bulb portion 104 has a wall defining an arc chamber 112.

Contained within arc chamber 112 is a fill of mercury, argon gas and the metal halides, sodium iodide and scandium tri-iodide. A pair of tungsten electrodes 114, 114' extend into arc chamber 112 from neck portions 108, 108' respectively. The tips of electrodes 114, 114' are spaced apart from one another by a distance A within arc chamber 112. Electrodes 114, 114' are lap welded to respective molybdenum ribbon foils 116, 116'. Quartz envelope 102 is hermetically sealed at ribbon foils 116, 116'. A pair of molybdenum wire inleads 118, 118' are lap welded respectively to ribbon foils 116, 116'. Lamp 100 is D.C. operated. Electrodes 114, 114' are straight shank tungsten wire electrodes of equal length, each having a pointed tip. Electrode 114 is the cathode and has a diameter of 0.1524 mm. Electrode 114' is the anode and has a diameter of 0.254 mm.

Typical physical parameters and performance data for lamp 100 are shown in Table 2.

TABLE 2

| 12 Watt Metal Halide Lamp | |
|---|---|
| Arc Chamber Diameter (D) | 0.3 cm |
| Arc Chamber Length (W) | 0.53 cm |
| Arc Chamber Volume | 0.016 $cm^3$ |
| Arc Distance (A) | 0.05 cm |
| Arc Loading | 240 |
| Aspect Ratio (W/D) | 1.8 |
| Chamber Wall Thickness (t) | 0.26 mm |
| Color Temperature | 3,800° K. |
| Efficacy | 64 lpw |
| Insertion Depth (1) | 0.24 cm |
| Insertion Factor (Y) | .91 |
| Mercury Loading | 1.4 mg |
| Metal Halide Loading (87% NaI, 13% $ScI_3$) | 0.075 mg |
| Neck Wall Thickness (n) | 0.75 mm |
| Wall Loading | 12 $w/cm^2$ |
| Warm-up Time | <12 sec. |

In the preferred embodiment of the 12 watt metal halide lamp of the present invention, the internal diameter D of arc chamber 112 may range between 0.29 and 0.32 cm. The length W of arc chamber 112 may range between 0.53 and 0.59 cm. The arc distance A may range between 0.5 to 0.8 mm. The aspect ratio (W/D) of arc chamber 112 may range between 1.7 and 2. An efficacy of 64 lumens per watt has been consistently achieved for the 12 watt metal halide lamp of the present invention. The insertion depth 1 may range between 2 and 2.8 mm. The wall thickness (t) of bulb portion 104 is approximately 0.26 mm. With these lamp parameters, the arc loading will exceed 150 watts /cm, with a wall loading of approximately 12 watts /cm$^2$. The wall thickness (n) of neck portions 108, 108' is less than 1.5 mm and, in most cases, is less than 0.75 mm.

In the preferred embodiment, the mercury loading is approximately 1.4 mg. The metal halide contained in arc chamber 112 comprises 87% sodium iodide and 13% scandium tri-iodide. The loading may range between 0.075 and 0.15 mg. The pressure of the argon gas, at room temperature, is 540 Torr (10.44 PSI Absolute). The color temperature of the lamp is 3,800° K.; and the warm-up time is less than 12 sec. It is believed that these parameter ranges are applicable to lamps having power inputs of between 11 and 13 watts.

Figure 5:
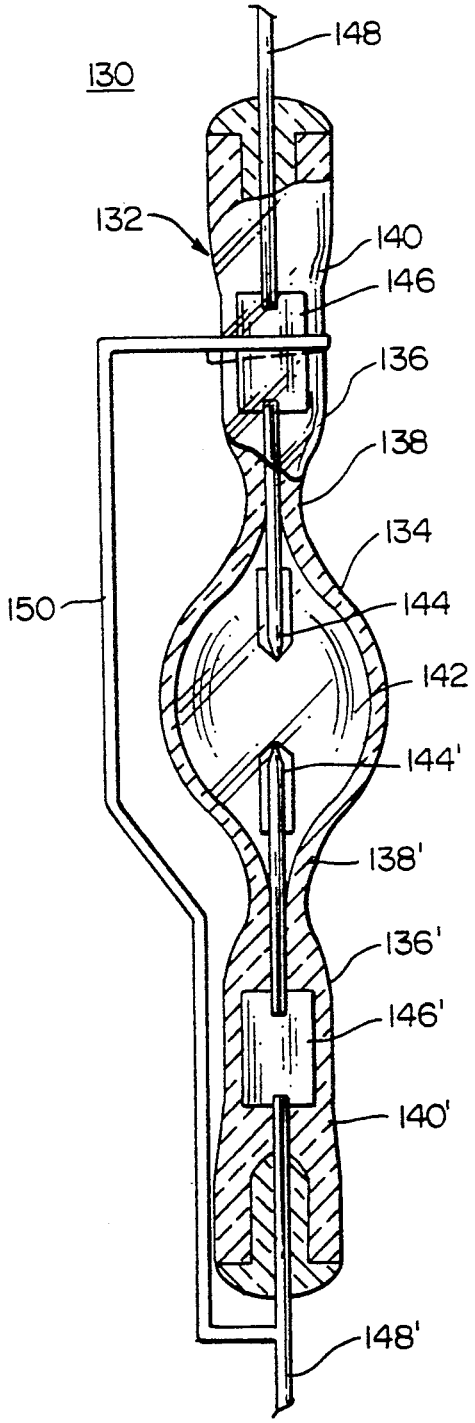
FIG. 5 is an enlarged partial cross-sectional view illustrating a 20 watt unbased metal halide lamp embodying the present invention.

Referring now to FIG. 5, there is shown a 20 watt metal halide lamp 130 constructed according to the present invention. Lamp 130 includes a fused quartz envelope 132 having a bulb portion 134 and a pair of end shanks 136, 136'. End shanks 136, 136' include transitional neck portions 138, 138' and stem portions 140, 140'. Bulb portion 134 has a wall defining an arc chamber 142 therein.

Contained within arc chamber 142 is a fill of mercury, argon gas and the metal halides, sodium iodide and scandium tri-iodide. A pair of tungsten wire electrodes 144, 144' extend into arc chamber 142 from stem portions 140, 140' respectively. The tips of electrodes 144, 144' are spaced apart from one another by a distance A within arc chamber 142. Electrodes 144, 144' are lap welded to respective molybdenum ribbon foils 146, 146'. Envelope 142 is hermetically sealed at ribbon foils 146, 146'. A pair of molybdenum wire inleads 148, 148' are lap welded respectively to ribbon foils 146, 146' As shown in FIG. 5, lamp 130 comprises an external starting aid 150. Starting aid 150 is electrically connected to wire inlead 148' at one end, and is wrapped around the exterior surface of stem portion 140 at the other end. Its function is identical to that described with respect to starting aid 40. Lamp 130 is D.C. operated. Electrodes 144, 144' are straight shank tungsten wire electrodes of equal length, each having a pointed tip. Electrode 144 is the cathode and has a diameter of 0.2032 mm. Electrode 144' is the anode and has a diameter of 0.254 mm.

The following table contains typical physical parameters and performance data for lamp 130.

TABLE 3

| 20 Watt Metal Halide Lamp | |
|---|---|
| Arc Chamber Diameter (D) | 0.37 cm |
| Arc Chamber Length (W) | 0.60 cm |
| Arc Chamber Volume | .039 cm$^3$ |
| Arc Distance (A) | 0.1 cm |
| Arc Loading | 200 |
| Aspect Ratio (W/D) | 1.6 |
| Chamber Wall Thickness (t) | 0.26 mm |
| Color Temperature | 3,800° K. |
| Efficacy | 103 lpw |
| Insertion Depth (1) | .25 cm |
| Insertion Factor (Y) | .83 |
| Mercury Loading | 2.8 mg |
| Metal Halide Loading (87% NaI, 13% $ScI_3$) | 0.125 mg |
| Neck Wall Thickness (n) | 0.75 mm |
| Wall Loading | 10 w/cm$^2$ |

TABLE 3-continued

| 20 Watt Metal Halide Lamp | |
|---|---|
| Warm-up Time | <30 sec. |

In the preferred embodiment of the 20 watt metal halide lamp of the present invention, the internal diameter D of arc chamber 142 may range from 0.37 to 0.39 cm. The length W of arc chamber 142 may range from 0.58 to 0.64 cm. The arc distance A between electrodes 144, 144' may range between 1 and 1.2 mm. The aspect ratio (W/D) of lamp 130 may vary between 1.5 and 1.7. The wall thickness (t) of bulb portion 134 is approximately 0.26 mm. The insertion depth 1 of electrodes 144, 144' may range between 2.25 and 2.8 mm. The wall thickness (n) of neck portions 138, 138' is less than 1.5 mm and, in most cases, is less than 0.75 mm.

With these physical parameters, the arc loading of lamp 130 will exceed 150 w/cm, while maintaining a wall loading of approximately 10 w/cm$^2$. The mercury loading contained within arc chamber 142 is approximately 2.8 mg. The metal halide additives contained within arc chamber 142 consist of 87% sodium iodide and 13% scandium tri-iodide. The metal halide loading may range between 0.05 and 0.225 mg. The pressure of the argon gas, at room temperature, is 540 Torr. The 20 watt metal halide lamp, according to the present invention, has achieved a consistent efficacy level of about 103 lumens /w with a color temperature of 3,800° K. The warm-up time is less than 30 sec. It is believed that these parameter ranges are applicable to lamps having power inputs of between 18 and 22 watts.

The envelopes of the lamps according to the present invention may be manufactured on a glass blowing lathe having a headstock and a tailstock, capable of both moving synchronously. The process begins with a piece of fused quartz tubing having an outside diameter of approximately 3 mm and an inside diameter of approximately 2 mm. For lamp envelopes intended to be operated above about 4 watts, the following steps are performed. Once the tubing is loaded into the lathe, a point along the tubing is heated with a burner until the quartz is plastic. Then, both the tailstock and the headstock of the lathe are moved synchronously apart at equal rates, to cause the tubing to be pulled with equal force at both ends and stretched to a desired length. The stretched portion of tubing is then heated slightly to shrink its diameter to a desired point.

This sequence of steps is repeated at a second point displaced from the initial point by a distance approximating the desired arc chamber length. The next step is to heat the section of tubing between the stretched points until the quartz is plastic. At the same time, nitrogen under pressure is introduced into the tubing to cause the plastic section of tubing to blow out to a desired arc chamber shape. The completed envelope is then detached from the tubing remaining in the lathe.

For lamp envelopes intended to be operated below about 4 watts, a section along the tubing is heated with a burner until the quartz is plastic. Then both the tailstock and headstock of the lathe are moved synchronously apart at equal rates to cause the tubing to be pulled with equal force at both ends and stretched to a desired length. The burner is then moved to the center of the stretched section to heat the quartz and maintain it in a plastic state. At the same time, nitrogen under pressure is introduced into the tubing to cause the center portion of the stretched section to blow out to a desired arc chamber shape.

Once the envelope has been formed by either of the two processes described above, the lamp is assembled. During the assembly process, the quartz envelope is held in a vertical position. An electrode assembly, including a molybdenum inlead wire, a molybdenum ribbon foil, and a tungsten electrode, is lowered into the top envelope shank. At the same time, the interior of the envelope is continuously flushed with a suitable inert dry gas, such as argon, which is directed upwardly through the envelope. Once the electrode part of the assembly is positioned correctly into the arc chamber, the neck of the top envelope shank is heated with two burners, one on each side of the neck. The heating is just sufficient to slightly shrink the neck tightly around the electrode shank. Wetting of the quartz does not occur around the electrodes and, therefore, a hermetic seal is not formed. The flushing of dry gas into the envelope continues to ensure that contamination is minimized.

Once the neck portion of the envelope shank is secured around the electrode shank, the burners are displaced upward to heat the stem portion of the envelope shank. The heating at this point causes shrinking and wetting of the quartz around the ribbon foil to establish a hermetic seal. Beyond this point, the stem is heated to cause it to shrink securely around the inlead wire. During any steps involving heating of the shank, the bulb portion of the envelope is continuously cooled by water. Care is always taken throughout the process to avoid contamination inside the envelope.

The position of the partially assembled lamp is rotated 180° so that the top envelope shank is now at the bottom. Inert dry gas continues to be flushed through the open shank into the envelope. At the same time, a metal halide pill containing the specified halide combination and quantity, is transferred into the bulb portion through the open shank. The specified amount of mercury is also transferred into the bulb portion through the open shank. Finally, an electrode assembly is lowered into the open envelope shank and sealed therein as earlier described to complete the assembly process.

Referring back to Examples 1-3 above, it can be seen that the amounts of mercury utilized per unit of arch chamber volume are 72 mg/cm$^3$ for the 20 watt lamp, 87.5 mg/cm$^3$ for the 12 watt lamp and 140 mg/cm$^3$ for the 2.5 watt lamp. Such high mercury loads, of course, produce high mercury vapor densities which are greater than anything shown in the prior art. This increase in the amount of mercury vapor present in the arc chamber will produce a correspondingly high voltage drop across the electrodes for a given lamp power input. This, in turn, reduces the amount of current needed to drive the lamp thereby extending electrode life and requiring the use of smaller size electrodes. It has been found that a lamp of the type herein described operating in the 18-35 watt range and having a wall thickness of between 0.5 and 1.5 mm will exhibit a very high efficacy. Similarly, high efficacy is produced by a lamp operating in the 11-13 watt range having a wall thickness of between 0.3 and 0.5 mm.

While the invention has been described in the specification and illustrated in the drawings with reference to the preferred embodiments, it will be understood by those skilled in the art that various changes may be made and equivalence may be substituted for elements of the invention without departing from the scope of the claims. In addition, many modifications may be made to adapt a particular situation or material to the teachings of the invention without departing from the essential scope thereof. Therefore, it is intended that the invention not be limited to the particular embodiments illustrated by the drawings and described in the specification as the best mode presently contemplated for carrying out the invention, but that the invention will include any embodiments falling within the description of the appended claims.

What is claimed is:

1. A metal halide arc discharge lamp that includes:

an envelope of light transmissive material including a bulb portion, a pair of transitional neck portions extending from said bulb portion and a pair of stem portions extending from said transitional neck portions;

said bulb portion of said envelope defining an arc chamber therein and having an external surface area of such valve as to produce a wall loading not exceeding about 35 watts/cm$^2$;

a fill of mercury, inert gas and a metal halide contained within said arch chamber, said mercury and said metal halide being adapted to substantially vaporize during operation of said lamp;

a pair of electrodes extending into said arch chamber from said pair of neck portions respectively and having electrode tips spaced apart from one another by a distance A within said arc chamber to produce an arc loading value that is greater than 150 watts/cm;

said neck portions of said envelope each having a wall surrounding a segment of said electrodes, respectively, the walls of said neck portions each having a reduced section;

said lamp having a power input rating in a range of about between 1.5 watts and 35.0 watts and the wall thickness of the neck portions having a reduced section in the range of about between 0.3 and 1.5 mm; and a pair of inlead assemblies electrically coupled to said pair of electrodes respectively and passing from said electrodes through a sealed section in said stem portions to the exterior of said lamp.

2. A lamp as recited in claim 1, wherein said bulb portion of said envelope has a wall defining said arc chamber, said wall having a substantially uniform thickness over a centrally disposed segment defined between two imaginary parallel planes located at the electrode tips respectively.

3. A lamp as recited in claim 1, wherein said arc chamber has a length W defined between said neck portions of said envelope; and wherein said electrodes have an insertion factor Y, corresponding to the formula $Y=(W-A)/W$, with a value greater than about 0.6.

4. A lamp as recited in claim 1, wherein said bulb portion of said envelope has a wall defining said arc chamber, said wall having a thickness not exceeding about 0.5 mm over a centrally disposed segment defined between two imaginary parallel planes located at the electrode tips respectively.

5. A lamp as recited in claim 1, said lamp has a power input rating in the range of from about 18 watts to 35 watts; and wherein the walls of said neck portions each have a stretched section with a minimum wall thickness in the range from about 0.5 to 1.5 mm.

6. A lamp as recited in claim 1, wherein said lamp has a power input rating of less than 11 watts; and wherein the walls of said neck portions each have a stretched section with a minimum wall thickness of less than 0.5 mm.

7. A lamp as recited in claim 2, wherein the wall of said bulb portion has a thickness not exceeding about 0.5 mm over the centrally disposed segment of the wall.

8. A lamp as recited in claim 3, wherein said bulb portion of said envelope has a wall defining said arc chamber, said wall having a substantially uniform thickness over a centrally disposed segment defined between two imaginary parallel planes located at the electrode tips respectively.

9. A lamp as recited in claim 7, wherein said arc chamber has a shape selected from the group of shapes consisting essentially of ellipsoids and spheroids and approximations thereof.

10. A lamp as recited in claim 8, wherein the wall of said bulb portion has a thickness not exceeding about 0.5 mm over the centrally disposed segment of the wall.

11. A lamp as recited in claim 9, wherein said arc chamber has a volume not exceeding 0.3 $cm^3$.

12. A lamp as recited in claim 10, wherein said arc chamber has a shape selected from the group of shapes consisting essentially of ellipsoids and spheroids and approximations thereof.

13. A lamp as recited in claim 12, wherein said arc chamber has a volume not exceeding 0.3 $cm^3$.

14. A lamp as recited in claim 1, wherein said fill of metal halide includes 87% sodium iodide and 13% scandium tri-iodide.

15. A lamp as recited in claim 1, wherein said lamp has a warm-up time of less than 30 seconds.

16. A metal halide arc discharge lamp having a power input rating of not more than 35 watts, said lamp comprising:

an envelope of light transmissive material including a bulb portion, a pair of transitional neck portions extending from said bulb portion, and a pair of stem portions extending from said transitional neck portions respectively, said bulb portion of said envelope defining an arc chamber therein and having an external surface area of such value as to produce a wall loading not exceeding about 35 watts /$cm^2$;

a fill of mercury, inert gas and metal halide contained within said arch chamber, said mercury and said metal halide being adapted to substantially vaporize during operation of said lamp;

a pair of electrodes, extending into said arc chamber from said pair of neck portions respectively, and having electrode tips spaced apart from one another by a distance A within said arc chamber to produce an arc loading value that is greater than 150 watts/cm, said neck portions of said envelope each having a wall surrounding a segment of said electrodes respectively, the walls of said neck portions each having a stretched section with a minimum wall thickness not exceeding about 1.5 millimeters;

a pair of inlead assemblies electrically coupled to said pair of electrodes respectively and passing from said electrodes through a sealed section in said stem portions to the exterior of said lamp;

said lamp having a power input of about 11 to 35 watts and wherein the insertion depth of said electrodes is greater than 1.5 mm.

17. A metal halide arc discharge lamp comprising:

an envelope of light transmissive material including a bulb portion, a pair of transitional neck portions extending from said bulb portion, and a pair of stem portions extending from said transitional neck portions respectively;

said bulb portion of said envelope defining an arc chamber therein and having an external surface area of such value as to produce a wall loading not exceeding about 35 watts /$cm^2$;

a fill of mercury, inert gas and metal halide contained within said arc chamber, said mercury and said metal halide being adapted to substantially vaporize during operation of said lamp;

a pair of electrodes, extending into said arc chamber from said pair of neck portions respectively, and having electrode tips spaced apart from one another by a distance A within said arc chamber, said neck portions of said envelope each having a wall surrounding a segment of said electrodes respectively, the walls of said neck portions each having a stretched section with a minimum wall thickness not exceeding about 1.5 millimeters;

a pair of inlead assemblies electrically coupled to said pair of electrodes respectively and passing from said electrodes through a sealed section in said stem portions to the exterior of said lamp; and said lamp having a power input of about 12 watts and said distance A between said electrode tips is in a range of about 0.5 to 0.8 mm to produce an arc loading having a value greater than 150 watts/cm.

18. A metal halide arc discharge lamp comprising:

an envelope of light transmissive material including a bulb portion, a pair of transitional neck portions extending from said bulb portion, and a pair of stem portions extending from said transitional neck portions respectively, said bulb portion of said envelope defining an arc chamber therein and having an external surface area of such value as to produce a wall loading not exceeding about 35 watts /$cm^2$;

a fill of mercury, inert gas and metal halide contained within said arc chamber, said mercury and said metal halide being adapted to substantially vaporize during operation of said lamp;

a pair of electrodes, extending into said arc chamber from said pair of neck portions respectively, and having electrode tips spaced apart from one another by a distance A within said arc chamber, said neck portions of said envelope each having a wall surrounding a segment of said electrodes respectively, the walls of said neck portions each having a stretched section with a minimum wall thickness not exceeding about 1.5 millimeters;

a pair of inlead assemblies electrically coupled to said pair of electrodes respectively and passing from said electrodes through a sealed section in said stem portions to the exterior of said lamp;

said lamp having a power input rating in the range of between about 18 watts to 22 watts and wherein the distance A between said electrode tips is between about 1.0 to 1.2 mm to produce an arc loading that is greater than 150 watts/cm.

19. A metal halide arc discharge lamp having a power input rating of not more than 35 watts, said lamp comprising:

an envelope of light transmissive material including a bulb portion, a pair of transitional neck portions extending from said bulb portion, and a pair of stem portions extending from said transitional neck portions respectively, said bulb portion of said envelope having a wall defining an arc chamber therein, said wall having an external surface area of such value as to produce a wall loading not exceeding about 35 watts/cm$^2$, said arc chamber having a length W defined between said neck portions of said envelope;

a fill of mercury, inert gas and metal halide contained within said arc chamber, said mercury and said metal halide being adapted to substantially vaporize during operation of said lamp;

a pair of electrodes, extending into said arc chamber from said pair of neck portions respectively, and having electrode tips spaced apart from one another by a distance A within said arc chamber to produce an arc loading value that is greater than 150 watts/cm, said electrodes having an insertion factor Y, corresponding to the formula $Y=(W-A)/W$, with a value greater than about 0.6, the wall of said bulb portion having a substantially uniform thickness not exceeding about 0.5 mm over a centrally disposed segment defined between two imaginary parallel planes located at the electrode tips respectively, said neck portions of said envelope each having a wall surrounding a segment of said electrodes respectively;

said lamp having a power input rating in a range of between 1.5 watts and 35 watts and the wall thickness of the neck portions having a reduced section in the range of about between 0.3 and 1.5 mm;

said arc chamber having a shape selected form the group of shapes consisting essentially of ellipsoids and spheroids and approximations thereof; and a pair of inlead assemblies electrically coupled to said pair of electrodes respectively and passing from said electrodes through a hermetically sealed section in said stem portions to the exterior of said lamp.

20. A lamp as recited in claim 19, wherein said lamp has a power input rating in the range of from about 18 to 22 watts; and wherein said distance A between said electrode tips is in the range of from about 1.0 to 1.2 mm to produce an arc loading with a value greater than 150 watts/cm.

21. A lamp as recited in claim 19, wherein said lamp has a power input rating in the range of from about 11 watts to 13 watts; and wherein the insertion depth of said electrodes is in the range of from about 2.0 to 2.8 mm.

22. A lamp as recited in claim 19, wherein said lamp has a power input rating in the range of from about 1.5 to 3.5 watts; and wherein the insertion depth of said electrodes is in the range of from about 0.6 to 0.8 mm.

23. A lamp as recited in claim 19, wherein said lamp has a power input of less than 11 watts; and wherein the walls of said neck portions each have a stretched section with a minimum wall thickness less than about 0.5 mm.

24. A lamp as recited in claim 19, wherein said lamp has a power input rating in the range of from about 11 watts to 35 watts; and wherein the insertion depth of said electrodes is greater than about 1.5 mm.

25. A lamp as recited in claim 19, wherein said lamp has a power input rating of about 12 watts; and wherein said distance A between said electrode tips is in the range of from about 0.5 to 0.8 mm to produce an arc loading with a value greater than 150 watts/cm.

26. A lamp as recited in claim 20, wherein the walls of said neck portions each having a reduced section with a minimum wall thickness less than about 0.75 mm.

27. A lamp as recited in claim 21, wherein the walls of said neck portions each having a reduced section with a minimum wall thickness less than about 0.75 mm.

28. A lamp as recited in claim 22, wherein the walls of said neck portions each have a reduced section with a minimum wall thickness less than about 0.3 mm.

29. A lamp as recited in claim 26, wherein said arc chamber has a volume of about 0.039 cm$^3$.

30. A lamp as recited in claim 27, wherein said arc chamber has a volume of about 0.016 cm$^3$.

31. A lamp as recited in claim 28, wherein said arc chamber has a volume of about $8\times10^{-4}$ cm$^3$.

32. A lamp as recited in claim 29, wherein said fill includes a mercury loading of about 2.8 mg.

33. A lamp as recited in claim 30, wherein said fill includes a mercury loading of about 1.4 mg.

34. A lamp as recited in claim 31, wherein said fill includes a mercury loading of about 0.112 mg.

35. A lamp as recited in claim 32, wherein the metal halide of said fill includes 87% sodium iodide and 13% scandium tri-iodide at a metal halide loading in the range of from about 0.05 to 0.225 mg.

36. A lamp as recited in claim 33, wherein the metal halide of said fill includes 87% sodium iodide and 13% scandium tri-iodide at a metal halide loading in the range of from about 0.075 to 0.15 mg.

37. A lamp as recited in claim 34, wherein the metal halide of said fill includes 87% sodium iodide and 13% scandium tri-iodide at a metal halide loading of about 0.025 mg.

* * * * *